US006223474B1

(12) United States Patent
Kafton

(10) Patent No.: US 6,223,474 B1
(45) Date of Patent: May 1, 2001

(54) GUTTER DRAINER ASSEMBLY

(76) Inventor: John A. Kafton, 4492 Heritage Heights Rd., De Pere, WI (US) 54115

( * ) Notice: Subject to any disclaimer, the term of this patent is extended or adjusted under 35 U.S.C. 154(b) by 0 days.

(21) Appl. No.: 09/274,272

(22) Filed: Mar. 22, 1999

(51) Int. Cl.[7] ..... B04D 13/064

(52) U.S. Cl. ..... 52/12; 52/13; 52/15; 52/16; 210/474

(58) Field of Search ..... 52/12, 13, 16, 52/15; 210/474

(56) References Cited

U.S. PATENT DOCUMENTS

| | | | | |
|---|---|---|---|---|
| 4,949,514 | | 8/1990 | Weller . | |
| 4,964,247 | * | 10/1990 | Spica | 52/12 |
| 5,103,601 | * | 4/1992 | Hunt | 52/12 |
| 5,107,635 | | 4/1992 | Carpenter . | |
| 5,109,640 | | 5/1992 | Creson . | |
| 5,242,591 | * | 9/1993 | Beechert | 210/474 |
| 5,409,602 | | 4/1995 | Sorenson . | |
| 5,535,554 | | 7/1996 | Harris, Jr. . | |

* cited by examiner

*Primary Examiner*—Carl D. Friedman
*Assistant Examiner*—Christy M. Syres
(74) *Attorney, Agent, or Firm*—Andrus, Sceales, Starke & Sawall, LLP

(57) ABSTRACT

A gutter drainer assembly comprising an elongated flat flexible strip that is dimensioned for installation in a rain gutter to prevent clogging of the rain gutter and downspouts. The strip includes two grooves formed therein and extending longitudinally along the length of the strip in parallel spaced relation for folding the strip into an inverted U-shaped channel which is installed in the gutter. The folded strip includes a top portion and two side members with a plurality of scalloped openings formed along the outer edges of the side members to allow water to flow through the openings and into an open channel created by the folded strip installed within the gutter. Pieces of the flexible strip may be connected together to cover the entire length of the gutter including inlet openings for downspouts. The gutter drainer assembly further comprising end members for covering the open ends of the folded strip at the ends of the gutter.

20 Claims, 3 Drawing Sheets

FIG. 3
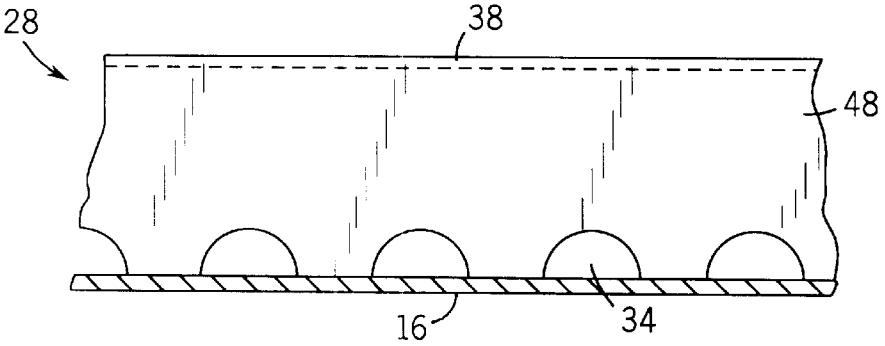
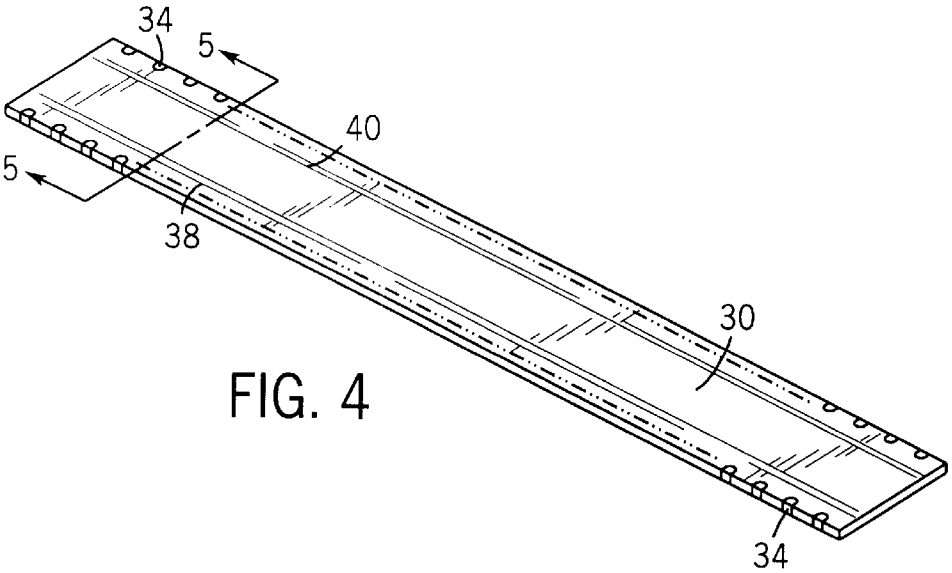
FIG. 4
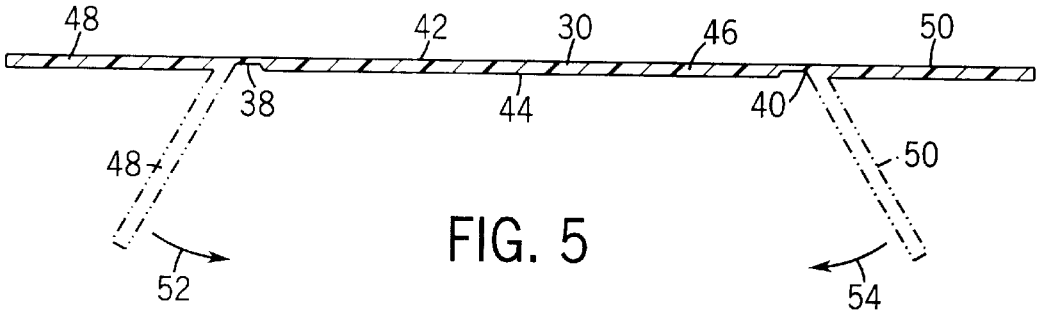
FIG. 5

GUTTER DRAINER ASSEMBLY

BACKGROUND OF THE INVENTION

The present invention relates to an apparatus for improving the flow of water in rain gutters and downspouts, and more particularly, to a gutter drainer assembly that is installed within a rain gutter to prevent clogging of the rain gutter and downspouts, and to allow the free flow of water within the rain gutter and downspouts.

The roofs of homes and other buildings typically have rain gutters or eaves troughs hung on the outer edge of the eaves below the roof line to catch and redirect rainwater flowing down from the roof. The gutters receive and redirect the flow of water into a downspout which carries the water to the ground.

A common problem with rain gutters and downspouts is that leaves, branches, pine needles and other debris often collect and accumulate within the gutters and downspouts, clogging them and preventing water from flowing through the gutters and into the downspouts. Also, when water from rain or melting snow flows down the roof, the debris on the roof is carried into the gutters and downspouts, clogging them both. If the gutters or downspouts are clogged, the gutters overflow onto the ground possibly causing soil erosion and/or damage to the building's foundation.

There have been various devices invented to prevent the clogging of rain gutters and downspouts. Specifically, there are patents that disclose cage-like structures positioned over the inlet of the downspout to prevent it from clogging. See, for example, U.S. Pat. No. 5,535,554 issued to Harris, Jr. and U.S. Pat. No. 5,409,602 issued to Sorenson.

In addition, there have been other devices, such as screens placed over the top of rain gutters, or devices inserted within the rain gutters that allow water to flow through the rain gutters to the downspouts and out onto the ground. Devices such as these can be seen in U.S. Pat. Nos. 4,949,514; 5,107,635; and 5,109,640.

However, most of these prior art devices are relatively difficult to install and maintain. Therefore, there is a need for a simple inexpensive device that effectively prevents the clogging of rain gutters and downspouts, and is easy to install and maintain.

SUMMARY OF THE INVENTION

The present invention provides a gutter drainer assembly for preventing clogging of gutters and downspouts, and allowing the free flow of water through the gutters and into inlets for the downspouts. The gutter drainer assembly includes an elongated flat flexible strip that is folded for installation in the gutter. The strip has a pair of grooves formed in the bottom surface thereof and extending longitudinally along the length of the strip in parallel spaced relation for folding the strip into an inverted U-shaped channel for installation in the gutter.

The grooves formed in the strip separate the strip into a top portion and two side members. The side members having a plurality of openings formed along their outer edges. The plurality of openings create passageways for water to flow through and into an open channel created by folding the side members downwardly and inwardly along the grooves formed in the strip.

The gutter drainer assembly further includes an end member for attaching to the open end of the gutter drainer assembly located at the end of the gutter. The end member having a top portion and a side portion, the top portion being positioned over the top portion of the strip and being attached thereto by a fastening device.

The gutter drainer assembly is preferably formed of an extruded polyethylene strip which is rolled up in rolls of various lengths. The strip is unrolled and installed along the entire length of the gutter including the corners of the gutter. Pieces of flexible strip may be connected together by fastening devices at the corners and ends of the gutter.

The gutter drainer assembly prevents the gutter and downspouts from being clogged by debris accumulating in the gutter. Water flowing into the gutter flows through the plurality of openings along the outer edges of the side members and into the inverted U-shaped channel created by the folded strip installed within the gutter. The flexible strip may also include through holes extending through the top portion of the strip for increasing the flow of water through the inverted U-shaped channel.

The invention also contemplates a method of preventing a gutter and downspouts from clogging including the steps of: installing an elongated flat flexible strip in the gutter; folding the elongated flat flexible strip along grooves formed within the strip to form an inverted U-shaped channel; and attaching an end member to the open ends of the gutter drainer assembly to prevent debris from entering the inverted U-shaped channel.

Various other features, objects, and advantages of the invention will be made apparent to those skilled in the art from the following drawings and detailed description.

BRIEF DESCRIPTION OF THE DRAWINGS

FIG. 3 is a front view of the installed gutter drainer assembly taken along line 3—3 of FIG. 2.

FIG. 4 is a perspective view of a gutter drainer strip prior to installation in a gutter.

FIG. 5 is a cross-sectional view of the gutter drainer strip taken along line 5—5 of FIG. 4.

DETAILED DESCRIPTION OF THE INVENTION

Figure 1:
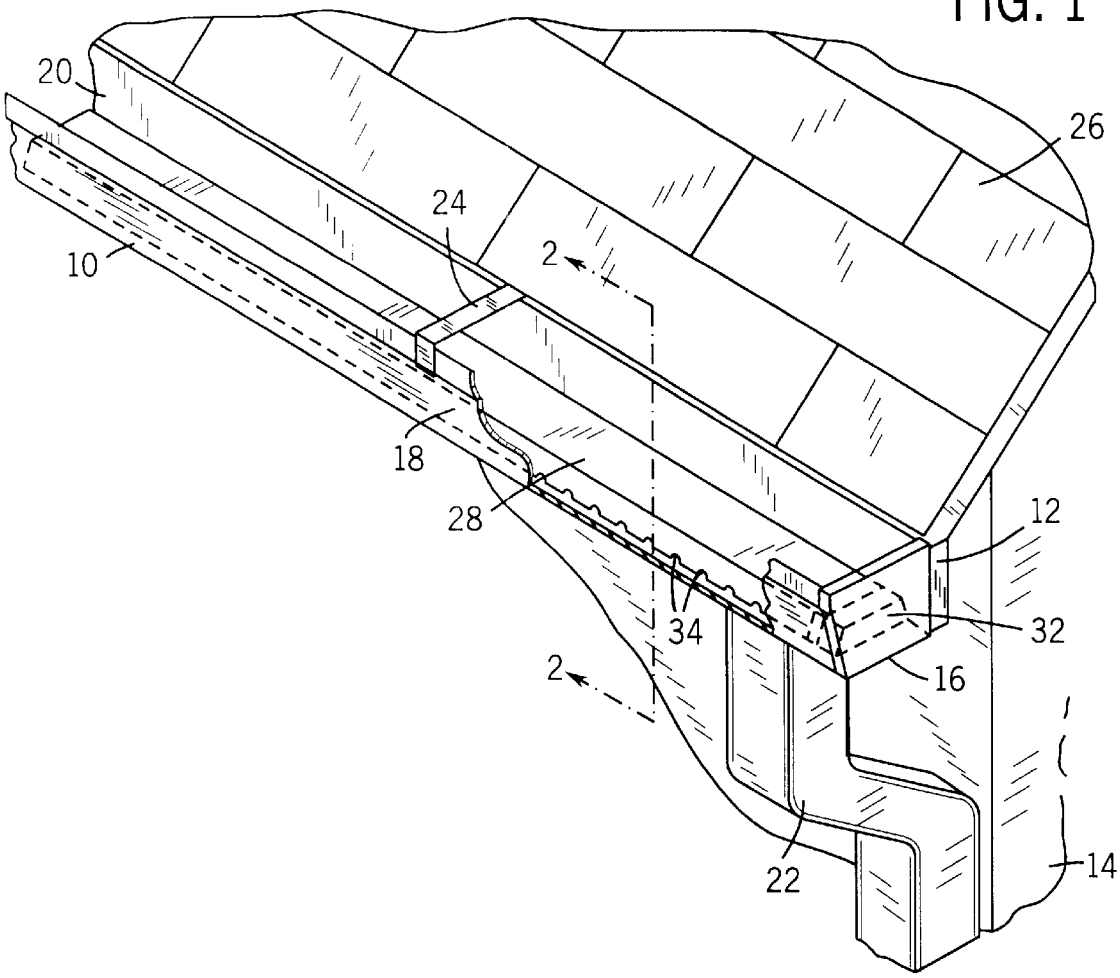
FIG. 1 is a perspective view of a rain gutter attached to the outer edge of an eaves surrounding a building, the rain gutter having a gutter drainer assembly installed therein in accordance with the present invention.

FIG. 1 illustrates a typical rain gutter 10 installed along the outer edge of an eaves 12 below the roof line of a building 14. The rain gutter 10 is generally U-shaped with a bottom portion 16, a front sidewall 18 and a rear sidewall 20. A downspout 22 associated with the gutter 10 is installed along the side of the building 14 adjacent one corner thereof. The gutter 10 is formed with an inlet opening (not shown) above the downspout for receiving the flow of water from the gutter 10 into the downspout 22 and out onto the ground.

FIG. 1 shows a bracket 24 fastened to the roof 26 of the building 14 for holding the gutter in place along the eaves 12. A gutter drainer assembly 28 is shown installed within the gutter 10. The gutter drainer assembly 28 includes an elongated flat flexible strip 30, FIG. 4, which may be folded into an inverted U-shaped channel and installed in the bottom of the gutter. The gutter drainer assembly 28 extends the entire length of the gutter covering the bottom portion 16 of the gutter including the inlet openings for the downspouts. The open ends of the gutter drainer assembly located at the ends of the gutter are capped with end members 32 which prevent debris from entering the open ends of the gutter drainer assembly. Formed within the outer edges of the flexible strip 30 are scalloped openings 34 which allow water to flow through the openings and into an open channel 36, FIG. 2, created by the inverted U-shaped gutter drainer assembly installed within the gutter.

FIG. 4. illustrates a portion of a strip 30 which may be folded into an inverted U-shaped channel and installed in a gutter. The flat flexible strip 30 is preferably rolled up in rolls of various lengths for easy distribution and installation. The strip is unrolled from the roll, folded into an inverted U-shaped channel and installed in the gutter. The elongated flat flexible strip 30 is preferably made of extruded polyethylene and is approximately 0.04 inches thick and 6 inches wide. The flexible strip 30 further includes a pair of grooves or folding lines 38, 40 formed within the strip for folding the strip into an inverted U-shaped channel for insertion in the gutter. The grooves 38, 40 extend longitudinally along the entire length of the strip in parallel spaced relation. Scalloped openings 34 are formed along the outer edges of the strip to allow water to flow through the openings and into an open channel 36, FIG. 2, created by the folded inverted U-shaped channel installed within the gutter.

FIG. 5 shows a cross sectional view of the gutter drainer strip 30 of FIG. 4. The flat flexible strip 30 includes a top surface 42 and a bottom surface 44. The grooves 38, 40 are formed in the bottom surface 44 of the flexible strip. The flexible strip 30 is folded downwardly along grooves 38, 40 to form an inverted U-shaped channel having a top portion 46 and two side members 48, 50. FIG. 5 illustrates folding the two side members 48, 50 of the flexible strip 30 downwardly and inwardly to form the inverted U-shaped channel as shown by arrows 52 and 54.

Figure 2:
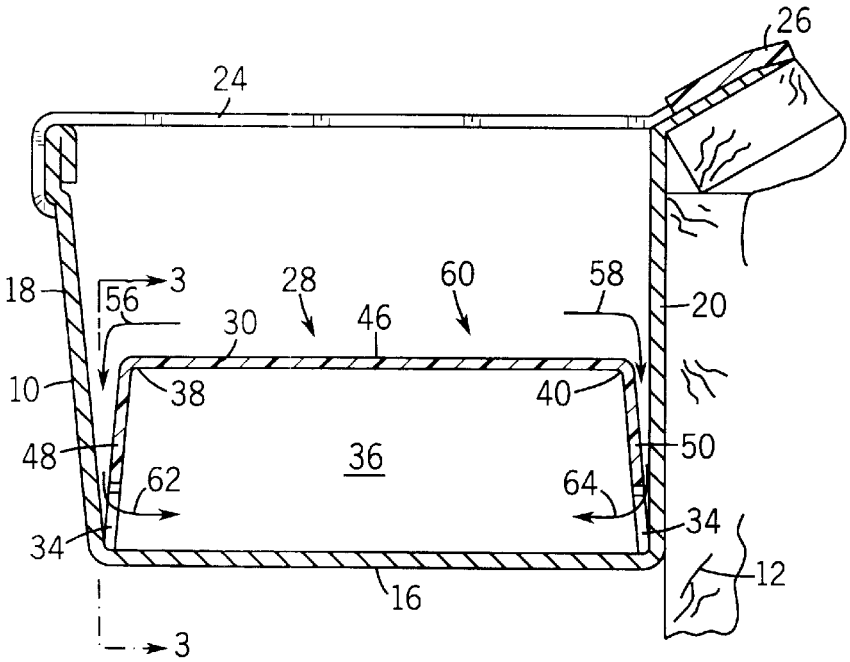
FIG. 2 is a cross-sectional view of the gutter and gutter drainer assembly taken along line 2—2 of FIG. 1.

FIG. 2 illustrates a cross sectional view of the gutter drainer assembly 28 installed within the gutter 10. The folded flexible strip 30 includes a top portion 46 located between two grooves 38, 40 and two side members 48, 50 located outside of the two grooves 38, 40. The elongated flat flexible strip 30 is installed in the gutter by folding the side members 48, 50 downwardly and inwardly to form an inverted U-shaped channel which is positioned in the bottom portion 16 of the gutter. The bottom portion 16, front sidewall 18 and rear sidewall 20 help retain the shape of the inverted U-shaped channel. The top portion 46 of the inverted U-shaped channel is preferably narrower in width than the bottom portion 16 of the gutter to allow water to flow between the side members 48, 50 of the folded strip 30 and the front and rear sidewalls 18, 20 of the gutter as shown by arrows 56, 58 in FIG. 2.

Operation of the gutter drainer assembly 28 is shown in FIG. 2. Water flowing into the gutter reaches the top portion 46 of the gutter drainer assembly 28 illustrated by arrow 60 and is directed from the top portion 46 to the open areas between the front and rear sidewalls 18, 20 of the gutter and side members 48, 50 of the gutter drainer assembly illustrated by arrows 56 and 58. The water then enters the scalloped openings 34 along the outer edges of the side members 48, 50 of the gutter drainer assembly and into the open channel 36 as shown by arrows 62 and 64. The water then flows through the channel 36 to an inlet opening (not shown) of a downspout which is also covered by the gutter drainer assembly 28. Leaves and other debris which may accumulate within the gutter are effectively prevented from clogging the gutters and downspouts by the inverted U-shaped gutter drainer assembly 28 installed within the gutters. The water flows through the debris and into the open channel created by the gutter drainer assembly.

The top portion 46 of the gutter drainer assembly 28 may include through holes (not shown) extending through the top portion 46 of the gutter drainer assembly 28 to improve the flow and drainage of water within the open channel 36. The through holes are preferably 3/16 inches in diameter and are spaced three inches apart in a staggered configuration of two rows within the top portion 46 of the gutter drainer assembly 28.

FIG. 3 illustrates a front view of the installed gutter drainer assembly 28 of FIG. 2. The scalloped openings 34 are formed within the outer edge of side member 48. The openings 34 are approximately 5/16 inches long by 3/8 inches high. The side member 48 is folded downwardly along groove 38 so that the outer edge of side member 48 rests against the bottom portion 16 of the gutter.

Figure 6:
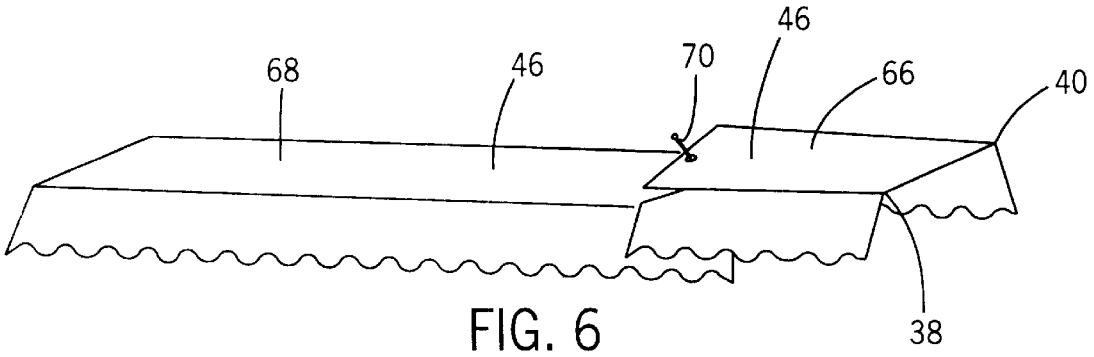
FIG. 6 is a perspective view of two pieces of gutter drainer strip being fastened together.

FIG. 6 illustrates joining two pieces of folded flexible strip. A first piece 66 is cut along grooves 38, 40 and positioned over a second piece 68. The first piece 66 is connected to the second piece 68 by a fastening device 70 extending through the top portions 46 of the strips. The fastening device 70 is preferably a self tapping sheet metal screw which allows for easy connection of two pieces of strip.

Figure 7:
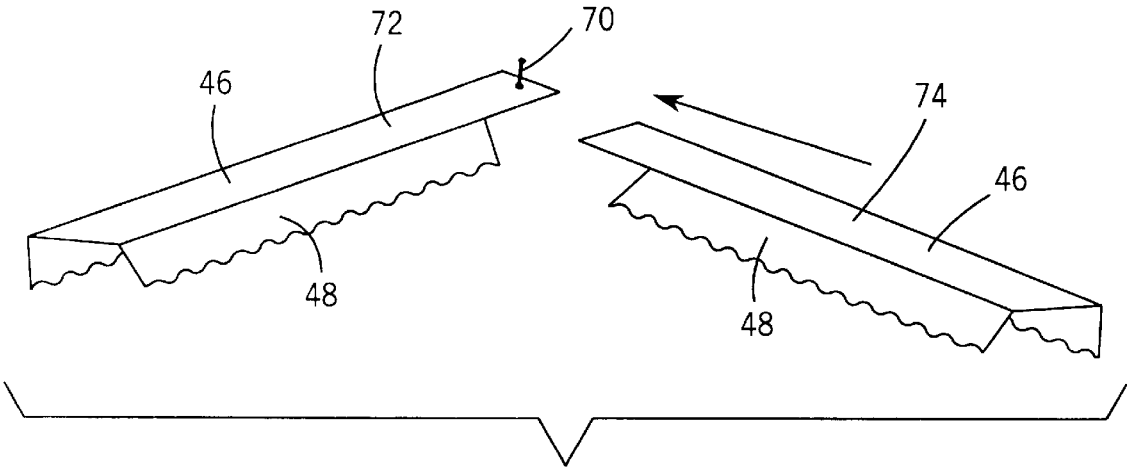
FIG. 7 is a perspective view of two pieces of gutter drainer strip being fastened together for installation in the corner of a gutter.

FIG. 7 illustrates joining two pieces of folded flexible strip for installation in the corner of a gutter. A portion of side member 48 from each piece is cut away so that the two pieces may be joined to form a 90° angle. The top portion 46 of a first piece 72 is positioned over the top portion 46 of a second piece 74 and connected thereto by a fastening device 70 extending through the top portions 46 of the strips. The fastening device 70 is preferably a self tapping sheet metal screw which allows for easy connection of two pieces of strip.

Figure 8:
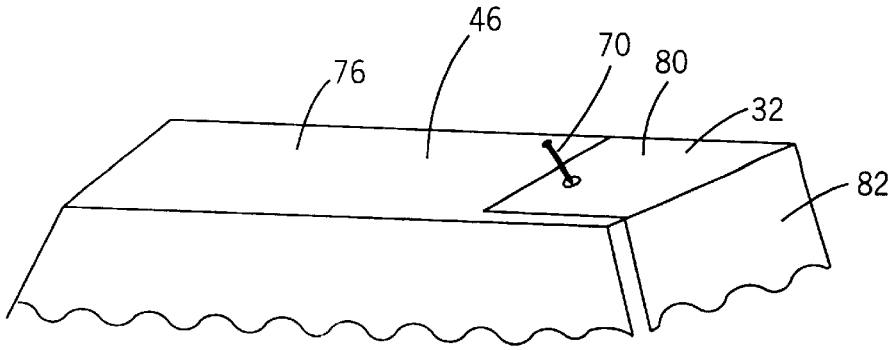
FIG. 8 is a perspective view of an end member being fastened to the end of a gutter drainer strip.

FIG. 8 shows a folded flexible strip 76 having an end member 32 attached to the open end of the strip 76 to prevent debris from entering the open end of the strip. The end member 32 having a top portion 80 and a side portion 82. The top portion 80 of the end member 32 is positioned over the top portion 46 of the flexible strip 76 and connected thereto by a fastening device 70 extending through the top portions 46, 80 of the strip and end member. The fastening device 70 is preferably a self tapping sheet metal screw which allows for easy connection of the end member 32 to the open end of the strip.

It is recognized that other equivalents, alternatives, and modifications aside from those expressly stated, are possible and within the scope of the appended claims.

What is claimed is:

1. A foldable apparatus of non-mesh material for insertion in a rain gutter, the apparatus preventing leaves and other debris from clogging the rain gutter, said apparatus comprising:

an elongated flat flexible strip of one layer dimensioned for installation in the rain gutter;

said flat flexible strip having a top smooth surface and a bottom smooth surface, said bottom surface having at least two fold lines formed therein and extending longitudinally along the length of the strip in parallel spaced relation; and;

said flexible strip including a substantially smooth, solid top portion and two substantially smooth solid side members except for a plurality of openings formed exclusively along outer edges of the side members in a spaced apart relationship the side members being manually foldable downwardly about the fold lines to define an inverted U-shaped assembly having the outer edges of the side members only contacting the bottom of the rain gutter when installed within the rain gutter, said plurality of openings creating a passageway for water to flow through and into an open channel created by the inverted U-shaped assembly installed within the rain gutter, the smooth top portions and side members except for the outer edges promoting water flow over their surfaces while preventing clogging from leaves and other debris.

2. The apparatus of claim 1 further comprising an end member for attaching to an open end of the inverted U-shaped assembly.

3. The apparatus of claim 2 wherein the end member has a top portion and a side portion, the top portion of the end member being positioned over the top portion of the flexible strip and connected thereto by a fastening device extending through the top portions of the strip and end member.

4. The apparatus of claim 3 wherein the fastening device is a self tapping sheet metal screw.

5. The apparatus of claim 2 wherein the end member is made of polyethylene.

6. The apparatus of claim 1 wherein the flexible strip is made of polyethylene.

7. The apparatus of claim 1 wherein the flexible strip is approximately 0.04 inches thick and 6 inches wide.

8. The apparatus of claim 1 wherein the plurality of openings are each approximately 5/16 inch long and 3/8 inch high.

9. The apparatus of claim 1 wherein the flexible strip includes through holes extending through the top portion of the flexible strip.

10. The apparatus of claim 1 wherein the top portion of the flexible strip is located between the two grooves, and the two side members are located outside of the two grooves.

11. The apparatus of claim 1 wherein the inverted U-shaped assembly is formed by folding the two side members of the flexible strip downwardly and inwardly along the grooves formed within the strip.

12. A foldable, 3-sided, non-mesh gutter drainer assembly comprising:

a flat flexible strip of one layer that is foldable into an inverted U-shaped channel for insertion in a gutter;

said flat flexible strip having at least two fold lines formed therein and extending longitudinally along the length of the strip in parallel spaced relation;

said flat flexible strip including a top substantially smooth, solid portion and two substantially smooth, solid side members except for a plurality of openings formed exclusively within outer edges of the side members, the side members being manually foldable about the fold lines to define the inverted U-shaped channel having the outer edges of the side members only contacting the bottom of the rain gutter when installed in the rain gutter; and an end member for attaching to an open end of the inverted U-shaped channel.

13. The gutter drainer assembly of claim 12 wherein at least two pieces of inverted U-shaped channel are attached together to cover the entire gutter.

14. The gutter drainer assembly of claim 12 wherein the flat flexible strip includes through holes extending through the top portion of the flat flexible strip.

15. The gutter drainer assembly of claim 12 wherein the inverted U-shaped channel creates a passageway for water to flow through, the water flowing through the plurality of openings into the passageway and into an inlet of a downspout.

16. The gutter drainer assembly of claim 12 wherein the strip is made of polyethylene.

17. The gutter drainer assembly of claim 12 wherein the end member is made of polyethylene.

18. A method of preventing a gutter and downspouts from clogging, said method comprising the steps of:

installing an elongated flat flexible strip of one layer of non-mesh material in the gutter, said elongated flat flexible strip including a substantially smooth, solid, top portion and two substantially smooth, solid side members except for a plurality of openings formed along outer edges of the side members;

manually folding the elongated flat flexible strip along fold lines formed within the strip to form an inverted U-shaped channel; and attaching an end member to open ends of the inverted U-shaped channel.

19. The method of claim 18 further comprising the step of attaching at least two pieces of inverted U-shaped channel together to cover the entire gutter.

20. The method of claim 18 further comprising the step of attaching at least two pieces of inverted U-shaped channel together at a corner of the gutter.

* * * * *

UNITED STATES PATENT AND TRADEMARK OFFICE

CERTIFICATE OF CORRECTION

PATENT NO. : 6,223,474 B1
DATED : May 1, 2001
INVENTOR(S) : John A. Kaftan

It is certified that error appears in the above-identified patent and that said Letters Patent is hereby corrected as shown below:

Title page,
Inventor, cancel "Kafton" and substitute therefor -- Kaftan --;

Signed and Sealed this

Thirteenth Day of November, 2001

*Attest:*

Nicholas P. Godici

NICHOLAS P. GODICI
*Acting Director of the United States Patent and Trademark Office*

*Attesting Officer*